United States Patent [19]

Leh

[11] 4,059,888

[45] Nov. 29, 1977

[54] METHOD OF MAKING A PIN ACTUATOR CONNECTOR

[75] Inventor: David T. Leh, Pottstown, Pa.

[73] Assignee: Sperry Rand Corporation, New York, N.Y.

[21] Appl. No.: 602,867

[22] Filed: Aug. 7, 1975

Related U.S. Application Data

[63] Continuation of Ser. No. 444,585, Feb. 21, 1974, abandoned.

[51] Int. Cl.[2] ..... H01R 43/00

[52] U.S. Cl. ..... 29/629; 339/64 M; 339/206 P

[58] Field of Search ..... 339/177 R, 60 M, 63 M, 339/62, 191 R, 220 R, 206 P, 64 R, 64 M; 264/150, 151, 154, 159, 163, 272; 29/629, 630 R, 630 A

[56] References Cited

U.S. PATENT DOCUMENTS

| | | | |
|---|---|---|---|
| 1,157,026 | 10/1915 | Meschenmoser | 339/64 R |
| 2,255,763 | 9/1941 | Doughman | 339/191 A |
| 2,787,770 | 4/1957 | Arson | 339/63 R |
| 2,801,398 | 7/1957 | Heppner | 339/206 P |
| 3,040,284 | 6/1962 | Connell | 339/61 |
| 3,386,072 | 5/1968 | Chandler | 339/191 R |
| 3,402,385 | 9/1968 | Feinberg | 339/191 R |
| 3,594,696 | 7/1971 | Witek | 339/60 |
| 3,675,188 | 7/1972 | Startin et al. | 339/220 R |
| 3,685,006 | 8/1972 | Jones | 339/177 R |
| 3,845,459 | 10/1974 | Normann | 339/191 R |

*Primary Examiner*—Carl E. Hall
*Attorney, Agent, or Firm*—Rene A. Kuypers

[57] ABSTRACT

There is disclosed herein an electrical connector device which is designed to provide strain relief for the connecting pins under a variety of loading conditions, such as misaligned and tolerance mismatch.

3 Claims, 1 Drawing Figure

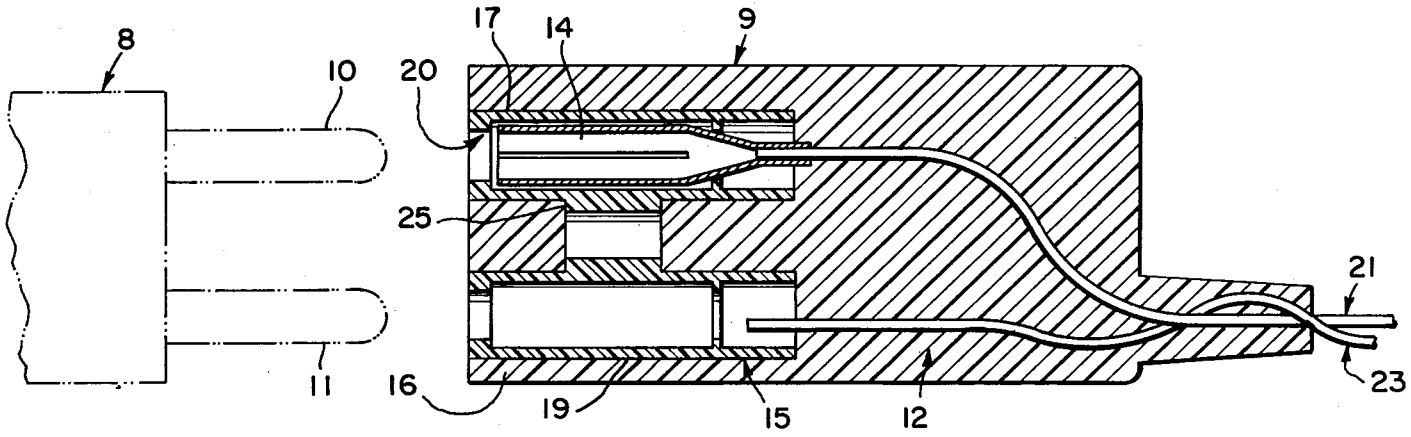
8
10
11
20
25
16
17
14
9
19
15
12
21
23

METHOD OF MAKING A PIN ACTUATOR CONNECTOR

This is a continuation, of application Ser. No. 444,585, filed Feb. 21, 1974, now abandoned.

BACKGROUND OF THE INVENTION

1. Field of the Invention

This invention relates to the field of male-female electrical connector devices.

2. Description of the Prior Art

In the known prior art of multi-pin connectors, a shortcoming that has become evident has been the eventual failure of the male-female portions to properly mate. This failure has been particularly evident in ganged connectors wherein there are a plurality of male-female connectors which are to be interconnected.

In this type of arrangement, manufacturing and assembly tolerances did not permit all of the receptacles in the connector to align with the mating pins. Therefore, distortion of the connector receptacles occurred which led to arcing and subsequent failure of the connection.

This shortcoming is particularly troublesome in large-scale electronic installations such as computers. Thus where there is a failure of a pin or pins in the interconnecting arrangement not only is it costly because it represents "down-time" of the computer operation, but it is often time consuming to trace and repair the defective pin.

Accordingly, the present invention is designed to provide a connector which provides a reliable electrical conductivity after many insertions and disconnects, as well as providing strain relief for the connecting pins under a variety of loading conditions.

SUMMARY OF THE INVENTION

The present invention incorporates a semi-rigid plastic female insert which is encapsulated within a flexible media. The insert is hinged so that the male portion of the connector may be inserted for a variety of pin loading conditions such as misalignment. For this condition, the insert yields to accomodate the misalignment and since the insert is encapsulated in a media which also yields, the distortion of the connector does not unduly load the connector.

The invention therefore provides a new and improved male-female connector assembly whose hallmark is reliability over long term usage.

BRIEF DESCRIPTION OF THE DRAWING

The FIGURE shown depicts the male-female assembly in disassembled form. The drawing also depicts the interrelationship of the H-shaped insert which is encapsulated within a flexible unit.

DESCRIPTION OF THE PREFERRED EMBODIMENT

Referring now in particular to the drawing, there is depicted a sectional view of a two-pin actuator connector. Although a two-pin actuator is disclosed as the preferred embodiment, the invention may be readily extended to a multi-pin connector utilizing the principles disclosed herein. The two pin actuator connector is composed of a male section 8 and a female section 9. The male section 8 is formed essentially of the two male connector pins 10, 11 which are embedded in a hard and unyielding plastic.

The female section 9 is formed of an encapsulation material 12 such as flexible vinyl which surrounds an H-shaped insert 15. The H-shaped insert 15 is formed of a molded plastic having two longitudinal or vertical members 17, 19 and a cross member 25. The molded insert in the preferred embodiment is made of nylon and is of rigid construction.

The cross member 25 is cylindrical in nature and relatively thin walled. The flexible vinyl encapsulation 12 permits the hinge to move freely and yet contain the assembly in the required configuration. In other words, the cross member 25 provides a multi-axis hinging or skewing action for the vertical members 17 and 19 within the encapsulation media 12.

The vertical members 17, 19 of the H-insert 15 are cylindrical in nature and are dimensioned to accept metal cylindrical receptacles 14 (only one of which is shown) which are split along their lengthwise dimension. The split receptacles 14 are fitted within the longitudinal members 17, 19 with a close tolerance fit. The terminals of the cylinders 14 are adapted to be connected to the wires 21, 23 by means of crimped or necked-down section of the cylinder.

The instant invention has been designed to provide reliable electrical conductivity after numerous insertions and disconnects as well as for providing strain relief for the connecting means under a variety of loading conditions. This is accomplished in the following manner. Let us asume that the male connector pins 10, 11 are out of tolerance or bent after long usage. In the prior art connector devices, this misalignment would cause the split receptacle 14 with respect to male connector 10 to open beyond its limit so that it became overstressed and took a permanent set. This of course jeopardizes the electrical conductivity of the connector and may eventually cause an electrical breakdown for equipment using such a connector.

The instant invention obviates this prior art problem by allowing the female receptacle 14 to open only enough to insert the pins 10, 11. However, if the male pins are stressed because they require further expansion, the multi-axis hinges 25 enables the vertical members 17, 19 to pivot and deliberately misalign in order to absorb the excess receptacle stress. As discussed above, the vertical member 17, 19 are able to absorb the overstress in view of the flexible nature of the encapsulation 12 and the ability of the members to revolve about the hollow, thin wall hinge 25.

The vertical members 17, 19 are designed with a shoulder 20 which butts up against the split cylinder. This feature is designed to prevent the metal cylinder from coming out of the vertical member of the H-insert 16 when there is a disengagement of the male and female connector.

What is claimed is:

1. The method of providing a male-female electrical connector device wherein split female receptacles may receive misaligned male connector pins without damage thereto comprising the steps of:

a. surrounding each of said split female receptacles with a respective rigid jacket of plastic material, each said receptacle being spaced from the walls of its rigid jacket, thereby allowing for expansion of said receptacle upon receipt of a misaligned male pin;

b. providing hinge means between said rigid jackets, thereby allowing one receptacle to be repositioned independently of the other receptacle when receiving a misaligned male pin c. encapsulating the hinged female receptacles and their respective rigid jackets in a flexible plastic material which yields sufficiently to allow relative movement between said female receptacles to prevent damage to said split female receptacles upon receipt of a misaligned male pin.

2. The method in accordance with claim 1 including the step of a. forming the jackets and the said hinged female receptacles into an integral H-shaped unit.

3. The method in accordance with claim 2 including the step of a. forming a shoulder in said plastic material surrounding said female receptacles to prevent removal from the H-shaped unit when said male member is disconnected from said female receptacle.

* * * * *